US007817055B1

(12) United States Patent
Scanlon

(10) Patent No.: US 7,817,055 B1
(45) Date of Patent: Oct. 19, 2010

(54) BOAT POWER ISOLATOR ADAPTER

(76) Inventor: Eugene Scanlon, 530 Kay Ter., Boca Raton, FL (US) 33432

( * ) Notice: Subject to any disclaimer, the term of this patent is extended or adjusted under 35 U.S.C. 154(b) by 822 days.

(21) Appl. No.: 11/010,034

(22) Filed: Dec. 11, 2004

(51) Int. Cl.
*G08B 21/00* (2006.01)

(52) U.S. Cl. ..... 340/657; 340/650; 340/656; 340/664; 439/488; 307/95

(58) Field of Classification Search ..... 340/657, 340/642, 650, 656, 664, 653, 638; 439/346, 439/369, 651, 106, 105, 650, 488, 638, 505; 307/20, 23, 29, 77, 87
See application file for complete search history.

(56) References Cited

U.S. PATENT DOCUMENTS 3,636,409 A 1/1972 Stephens
3,769,926 A 11/1973 Race
3,924,914 A * 12/1975 Banner ..... 439/105
3,930,977 A 1/1976 Wood
4,117,345 A 9/1978 Balcom
4,875,152 A * 10/1989 Foster ..... 363/146
5,302,857 A 4/1994 Charles
5,574,610 A 11/1996 Tachick
5,840,164 A 11/1998 Staerzl
6,095,850 A * 8/2000 Liu ..... 439/488
6,559,660 B1 * 5/2003 Staerzl ..... 324/712
6,724,589 B1 4/2004 Funderburk
6,753,755 B2 * 6/2004 Montague ..... 337/265

* cited by examiner

*Primary Examiner*—Anh V La

(57) ABSTRACT

A galvanic ground isolator adapter protects against galvanic corrosion on a boat when a boat power system is connected to a shore power system. A ground isolation assembly in the ground connection between the two system grounds prevents current from passing between the two system grounds when the voltage difference between the two is low. When the voltage difference exceeds a preset value, the ground connection is established. The adapter is entirely contained within a rigid housing with a male plug at one end and a female socket at the other end. In this form it can be simply connected to a power cord that is normally used in connecting the shore and boat power systems. It may be provided with a locking mechanism that prevents it being removed once it is attached. It may be supplied with a sonic alarm to indicate when current is flowing in the ground connection.

8 Claims, 4 Drawing Sheets

BOAT POWER ISOLATOR ADAPTER

This invention relates to power connections, and more particularly to an adapter for protecting a boat, its personnel, and electrical system when the boat's electrical system is plugged into a shore power supply.

BACKGROUND OF THE INVENTION

When a boat electric system is plugged into a shore power system, a galvanic isolator is often positioned in series with the connection between shore ground and boat ground. The galvanic isolator prevents the flow of destructive galvanic currents, while maintaining the safety of function of a neutral ground by conducting when the difference of potential between the two grounds exceeds a preset amount. The isolator generally is made to block current when the potential difference is below about 1.4 volts, and conduct above that value. U.S. Pat. No. 5,840,164 issued Nov. 24, 1998 to Staerzl discusses the problems encountered with heat dissipation when large currents flow through the ground circuit. The isolators of the prior art are large, expensive, and difficult to mount with adequate ventilation in the confines of some boats. Consequently, they are often omitted. This can lead to dangerous corrosion, fire, and shock hazards.

SUMMARY OF THE INVENTION

It is accordingly an object of the invention to provide a power isolator that can be installed as easily as plugging a power cord between shore and boat electric systems. It is another object of the invention to provide a power isolator that is low in cost to encourage usage. It is another object of the invention to provide a power isolator that is unitary in construction for ease of use. These and other objects, features, and advantages of the invention will become more apparent when the detailed description is studied in conjunction with the drawings in which like elements are designated by like reference characters in the various drawing figures.

DETAILED DESCRIPTION OF PREFERRED EMBODIMENTS

Figure 1:
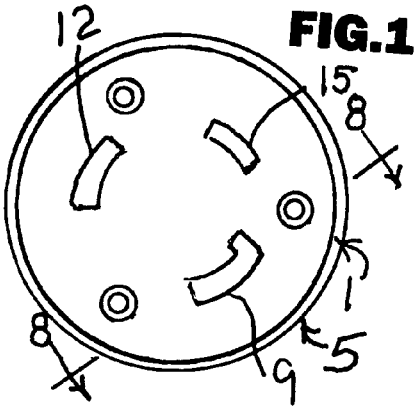
FIG. 1 is an end view of an isolator of the invention from the plug end.
Figure 2:
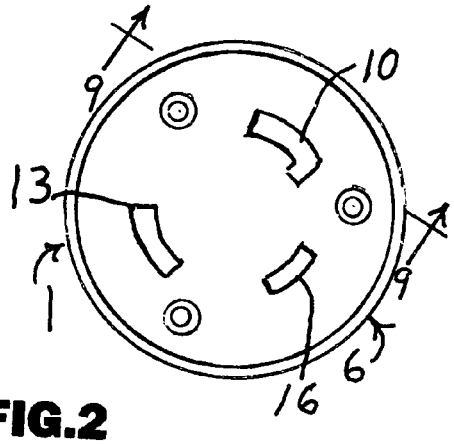
FIG. 2 is an end view of the isolator of FIG. 1 from the socket end.
Figure 6:
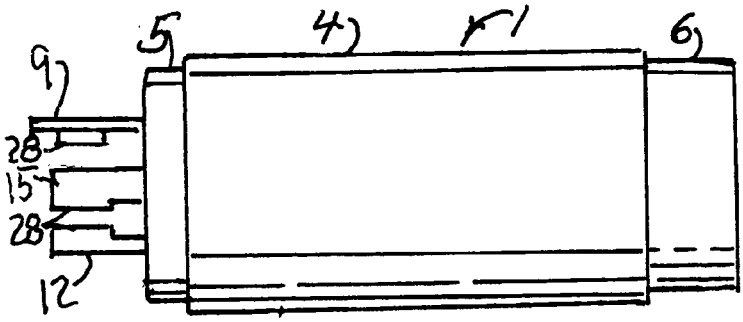
FIG. 6 is a side view of the isolator of FIG. 1.
Figure 5:
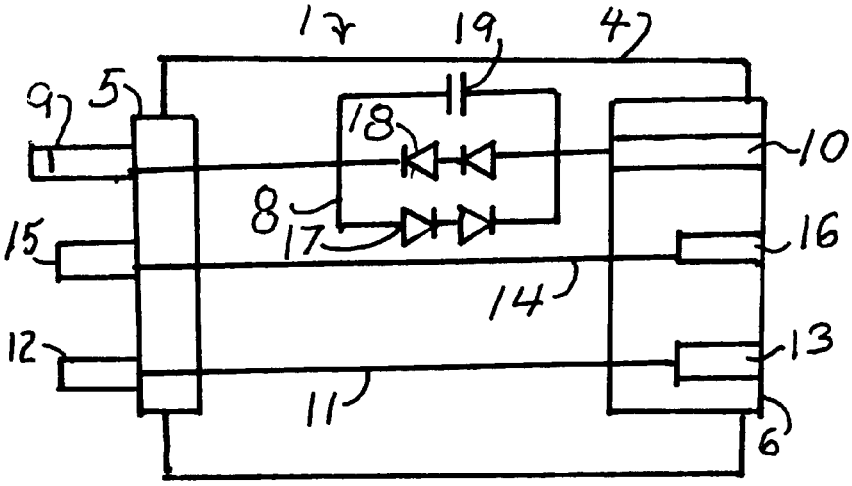
FIG. 5 is a schematic diagram of the isolator of FIG. 1.

Referring now to the drawing FIGS. 1-6, a compact unitary adapter 1 of the invention comprises a rigid housing 4 having a first end 5, which may be termed the plug end, with prongs

Figure 3:
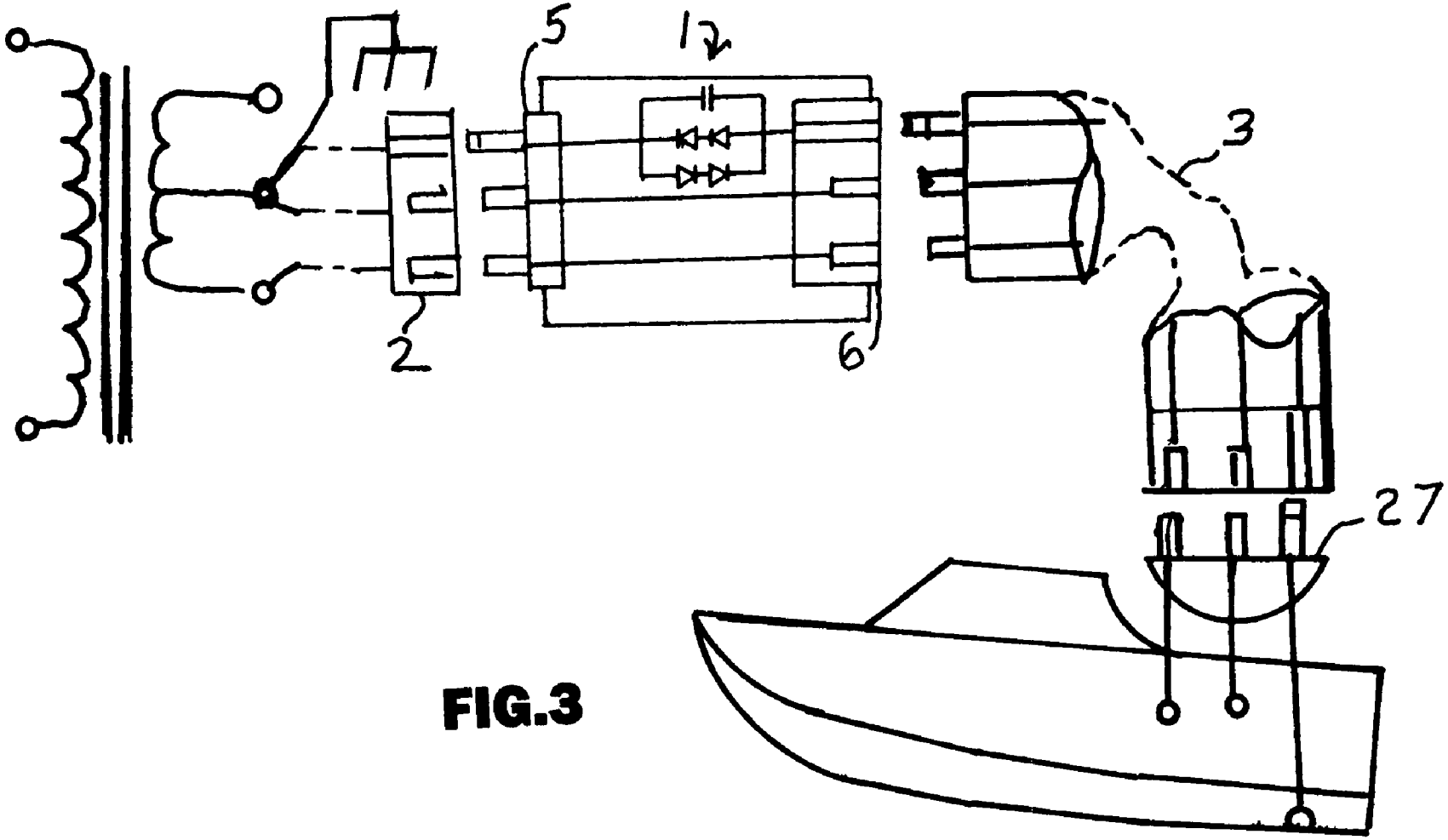
FIG. 3 is a diagrammatic view of the isolator of FIG. 1 in use.
Figure 4:
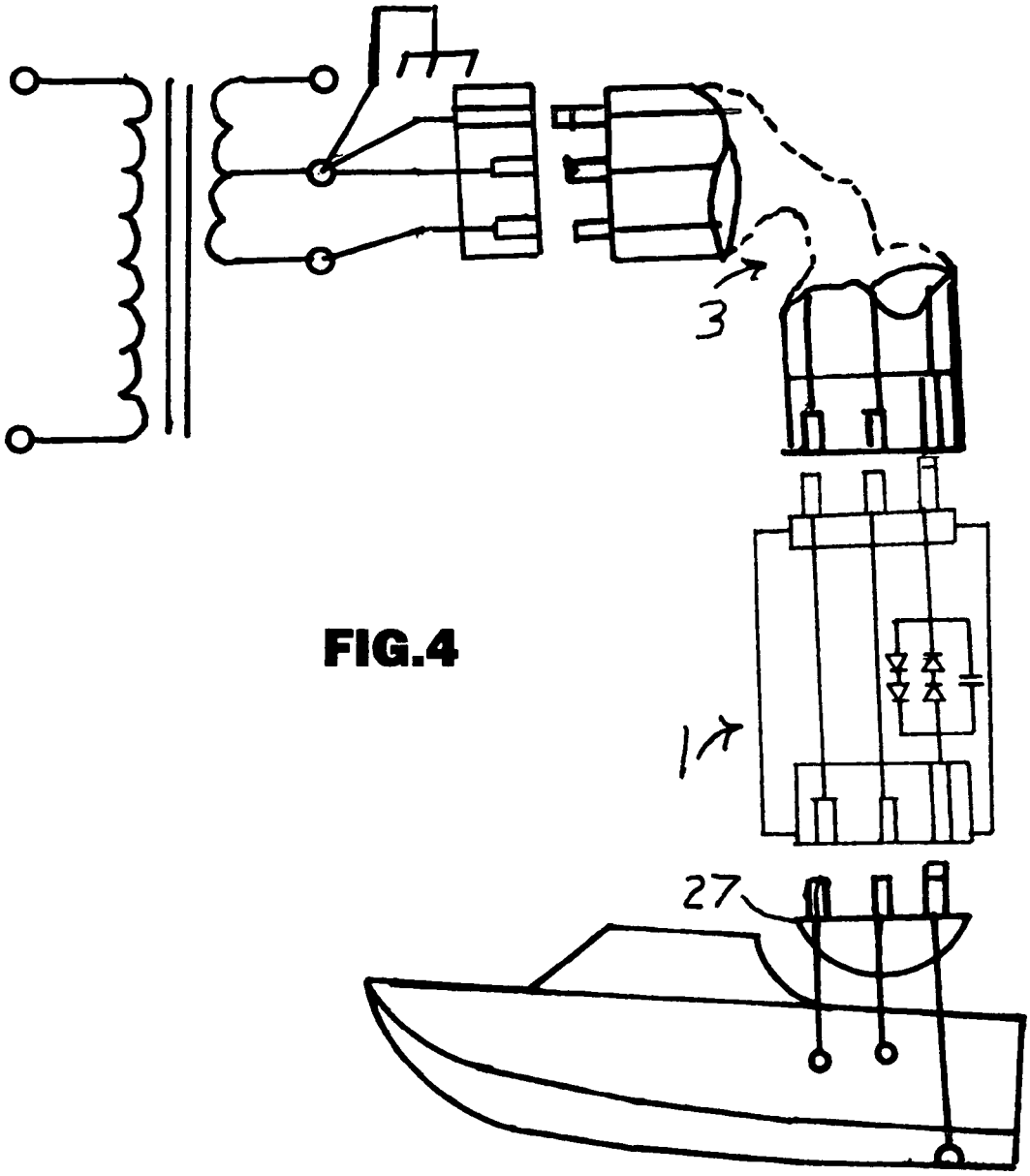
FIG. 4 is another diagrammatic view of the isolator of FIG. 1 in use.

9,12, and 15 for plugging into recesses in a receptacle. A second end 6, which may be termed the socket end, is provided with three recesses 10, 13, and 16 for receiving prongs of a connector. A ground circuit having a ground isolation assembly 8, of the type well known in the art, is electrically connecting the ground prong 9 with the ground recess contact 10. The ground isolation assembly 8 comprises a first diode stack 17 and a second diode stack 18, conductive in opposite directions, connected in parallel along with one or more bypass capacitors 19. The diodes block galvanic current flow in the ground circuit when voltage difference between the ends is below a preset voltage such as 1.4 volts. A greater voltage causes current to flow through one of the diode stacks to thereby provide a protective ground. A neutral circuit 14 electrically connects the neutral prong 15 with the neutral recess contact 16. A hot circuit 11 electrically connects the hot prong 12 with the hot recess contact 13. As best seen in FIG. 3, a shore power source receptacle 2 may be connected to a boat electrical system power plug 27 through the usual flexible elongate power cord 3, with the adapter 1 of the invention interposed between the shore power receptacle 2 and the power cord 3 of varying lengths. Alternatively, as shown in FIG. 4, the adapter 1 may be interposed between the boat plug 27 and the power cord 3. No special skills are involved in the installation, only the skills involved in connecting the power cord. The connectors of this art have one or all of the prongs provided with a terminal projection 28. The plug in inserted axially and then rotated clockwise to cause the projection(s) to lock in place. This prevents the connection from pulling apart axially when tension is applied to the cord. The adapter is located in free space where it can easily dissipate heat. It does not occupy any space in the boat. It is small, and inexpensive to produce.

Figure 7:
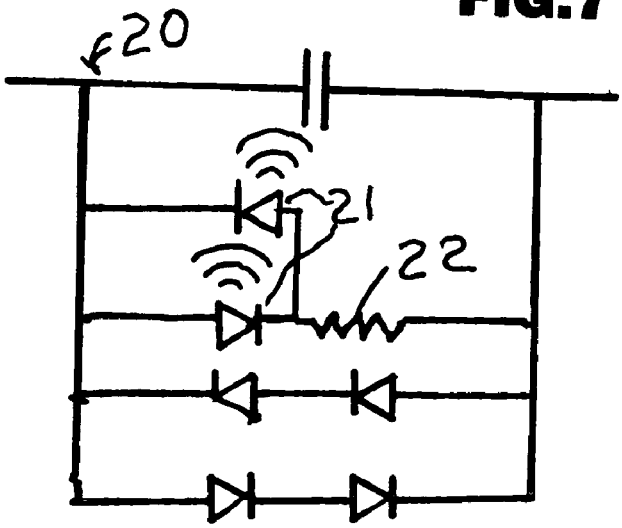
FIG. 7 is a schematic diagram of the ground isolation assembly of another isolator of the invention.

Referring now to FIG. 7, another embodiment of the ground isolation assembly 20 is shown. It is provided with a pair of sonic emitter assemblies 21 of opposite polarity with dropping resistor 22. This embodiment provides a sound alarm that sounds off to warn that excess current is flowing in the ground circuit.

Figure 8:
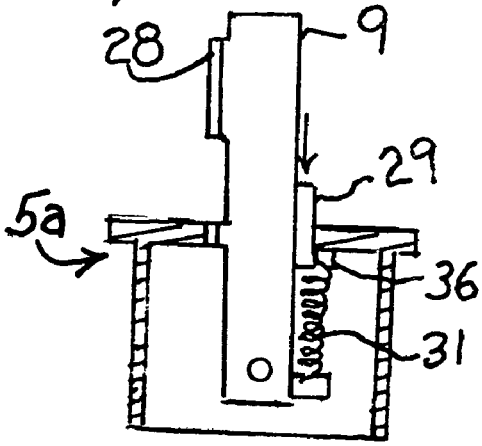
FIG. 8 is a sectional detail view taken through line 8-8 of FIG. 1 of a locking construction for an isolator of the invention.

To discourage theft of the adapter, it may be provided with means to prevent removal of the adapter after it has been connected in the shore to boat power connection. This may be useful at a marina with many shore sockets provided with the connection shown in FIG. 3. The marina could provide this protection to all its sockets by retrofitting them with the adapters of the invention with little effort or expense. However, a thief could make off with all of them if they were just as easily removed. FIG. 8 shows a means at the plug end 5*a* of the adapter that causes it to irremovably lock onto a socket connector after the prongs are inserted axially and the plug is rotated clockwise in the usual manner. This discourages theft. A spring biased locking bar 29 is mounted adjacent the prong 9. It extends from below the surface of the plug end 5*a* to above the surface. Bent end 36 of bar 29 limits the extension of the bar by the compression spring 31. When the prong 9 of the plug is inserted axially into the arcuate recess of a socket, the locking bar is depressed by the face of the socket. When the plug is then rotated clockwise to lock the connection, the bar is urged up by the spring into the space no longer occupied by the prong. When the locking bar is in this position occupying space in both plug and socket, the plug cannot rotate counterclockwise and the lateral terminal projection 28 on the prong prevents axial movement to disconnect it.

Figure 9:
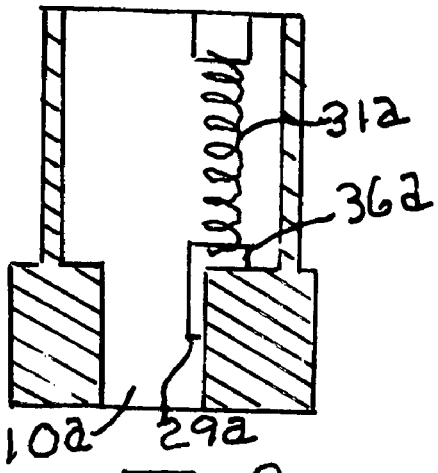
FIG. 9 is a sectional detail view through line 9-9 of FIG. 2 of another locking construction for an isolator of the invention.

Referring now to FIG. 9, a means for irremovably locking the socket end 6*a* of an adapter of the invention to a plug is shown. This may be useful in the configuration shown in FIG. 4. A spring biased locking bar 29*a* is mounted within the recess 10*a* in the socket end. Bent end 36*a* of bar 29*a* limits the extension of the bar by the compression spring 31*a*. When a prong of a plug is inserted axially into the arcuate recess 10*a*, the locking bar is depressed by the prong. When the plug is then rotated clockwise to lock the connection, the bar is urged up into the space no longer occupied by the prong. When the locking bar is in this position occupying space in both plug and socket, the plug cannot rotate counterclockwise and the lateral terminal projection 28 on the prong prevents axial movement to disconnect it.

While I have shown and described the preferred embodiments of my invention, it will be understood that the invention may be embodied otherwise than as herein specifically illustrated or described, and that certain changes in form and arrangement of parts and the specific manner of practicing the invention may be made within the underlying idea or principles of the invention.

What is claimed is:

1. A unitary galvanic isolator adapter for connecting a shore alternating current power source receptacle that has three electric contacts to a boat electrical system power cord, the adapter comprising:

a) rigid housing having a first end and an opposing second end;

b) three prongs extending from the first end adapted for electrically connecting to the three electric contacts in the shore power receptacle;

c) three recessed contacts in the second end for receiving three prongs from a power cord connectable to the boat electrical system;

d) a ground circuit having a ground isolation assembly electrically connecting a first prong in the first end to a first recessed contact in the second end;

e) a neutral circuit electrically connecting a second prong in the first end to a second recessed contact in the second;

f) a hot circuit electrically connecting a third prong in the first end to a third recessed contact in the second end; and g) means within the second end for capturing at least one prong from a connector of the cable connectable to the boat electrical system to thereby prevent removal therefrom after it has been connected thereto.

2. The adapter according to claim 1 further comprising a sonic alarm in the ground isolation circuit constructed to emit sound when current is flowing in the ground circuit.

3. The adapter according to claim 2 in which the ground isolation assembly comprises two diode stacks of opposite conductivity and a capacitor in parallel.

4. The adapter according to claim 1 in which the ground isolation assembly comprises two diode stacks of opposite conductivity and a capacitor in parallel.

5. A unitary galvanic isolator adapter for connecting a shore alternating current power source receptacle that has three electric contacts to a boat electrical system, the adapter comprising:

a) a rigid housing having a first end and an opposing second end;

b) three prongs extending from the first end adapted for electrically connecting to three recessed electric contacts in a receptacle;

c) three recessed contacts in the second end for receiving three prongs from a power plug;

d) a ground circuit having a ground isolation assembly electrically connecting a first prong in the first end to a first recessed contact in the second end;

e) a neutral circuit electrically connecting a second prong in the first end to a second recessed contact in the second end;

f) a hot circuit electrically connecting a third prong in the first end to a third recessed contact in the second end; and g) means in at least one prong in the first end for irremovably engaging at least one recessed contact in a female receptacle to thereby prevent removal therefrom after it has been connected thereto.

6. The adapter according to claim 5 further comprising a sonic alarm in the ground isolation circuit constructed to emit sound when current is flowing in the ground circuit.

7. The adapter according to claim 6 in which the ground isolation assembly comprises two diode stacks of opposite conductivity and a capacitor in parallel.

8. The adapter according to claim 5 in which the ground isolation assembly comprises two diode stacks of opposite conductivity and a capacitor in parallel.

* * * * *